US009243825B2

(12) United States Patent
Mikheev et al.

(10) Patent No.: US 9,243,825 B2
(45) Date of Patent: Jan. 26, 2016

(54) COOLING APPARATUS AND METHOD

(75) Inventors: Vladimir Mikheev, Bicester (GB); Par G. Teleberg, Abingdon (GB); Anthony Matthews, Abingdon (GB); Justin Elford, Oxon (GB)

(73) Assignee: Oxford Instruments Nanotechnology Tools Limited (GB)

( * ) Notice: Subject to any disclaimer, the term of this patent is extended or adjusted under 35 U.S.C. 154(b) by 211 days.

(21) Appl. No.: 13/988,446

(22) PCT Filed: Nov. 11, 2011

(86) PCT No.: PCT/GB2011/052201
§ 371 (c)(1),
(2), (4) Date: Aug. 6, 2013

(87) PCT Pub. No.: WO2012/066312

PCT Pub. Date: May 24, 2012

(65) Prior Publication Data

US 2013/0319019 A1 Dec. 5, 2013

(30) Foreign Application Priority Data

Nov. 18, 2010 (GB) ..... 1019530.3
May 23, 2011 (GB) ..... 1108605.5

(51) Int. Cl.
*F25B 41/00* (2006.01)
*F25B 9/10* (2006.01)
(Continued)

(52) U.S. Cl.
CPC . *F25B 41/00* (2013.01); *F25B 9/10* (2013.01); *F25D 19/006* (2013.01); *F28D 15/02* (2013.01); *F28D 15/0275* (2013.01); *F25B 2500/26* (2013.01)

(58) Field of Classification Search
CPC ..... F25B 9/10; F25B 41/00; F25B 2500/26; F28D 15/02; F28D 15/0275; F28D 19/006
USPC ..... 62/56, 333, 513, 515
See application file for complete search history.

(56) References Cited

U.S. PATENT DOCUMENTS 5,207,674 A * 5/1993 Hamilton ..... 606/20
5,226,580 A * 7/1993 Hartle et al. ..... 228/113
(Continued)

FOREIGN PATENT DOCUMENTS

DE 102006059139 A1 6/2008
EP 905436 A2 3/1999
(Continued)

OTHER PUBLICATIONS

Jeong S et al.: "Experimental Investigation on the Detachable Thermosiphon for Conduction-cooled Superconducting Magnets", Cryogenics, Elsevier, Kidlington, GB, vol. 46, No. 10, Oct. 1, 2006, pp. 705-710.
(Continued)

*Primary Examiner* — Mohammad M Ali
(74) *Attorney, Agent, or Firm* — Blank Rome LLP

(57) ABSTRACT

Cooling apparatus is provided which comprises a mechanical refrigerator and a heat pipe. The mechanical refrigerator has a first cooled stage and a second cooled stage, the second cooled stage being adapted to be coupled thermally with target apparatus to be cooled. The heat pipe has a first part coupled thermally to the first stage of the mechanical refrigerator and a second part coupled thermally to a cooled member which may comprise the second stage of the mechanical refrigerator. The heat pipe is adapted to contain a condensable gaseous coolant when in use. An example coolant is Krypton. The apparatus is operated in a first cooling mode in which the temperature of the cooled member causes the coolant within the second part of the heat pipe to be gaseous and the temperature of the first stage causes the coolant in the first part to condense, whereby the cooled member is cooled by the movement of the condensed liquid from the first part to the second part of the heat pipe. When the cooled member is the second stage of the mechanical refrigerator, the heat pipe provides heat between the higher and lower temperature cooled stages during cooling. An associated method of operating such apparatus is also described.

14 Claims, 9 Drawing Sheets

(51) Int. Cl.

| | |
|---|---|
| ***F25D 19/00*** | (2006.01) |
| ***F28D 15/02*** | (2006.01) |

(56) References Cited

U.S. PATENT DOCUMENTS

| | | | | |
|---|---|---|---|---|
| 5,251,456 | A * | 10/1993 | Nagao et al. | 62/259.2 |
| 5,293,749 | A * | 3/1994 | Nagao et al. | 62/6 |
| 5,842,348 | A | 12/1998 | Kaneko et al. | |
| 6,076,372 | A | 6/2000 | Acharya et al. | |
| 7,263,841 | B1 * | 9/2007 | Arman et al. | 62/51.1 |
| 7,425,211 | B2 * | 9/2008 | Levin et al. | 606/20 |
| 8,139,359 | B2 * | 3/2012 | Jaggi et al. | 361/700 |
| 2004/0182089 | A1 * | 9/2004 | Lehmann et al. | 62/6 |
| 2006/0048522 | A1 * | 3/2006 | Yamada | 62/6 |
| 2006/0086482 | A1 * | 4/2006 | Thayer et al. | 165/104.26 |
| 2006/0102618 | A1 * | 5/2006 | Lakner et al. | 219/538 |
| 2007/0146996 | A1 * | 6/2007 | Herring et al. | 361/700 |
| 2008/0148756 | A1 * | 6/2008 | Oomen et al. | 62/259.2 |
| 2010/0248968 | A1 | 9/2010 | Stautner | |

FOREIGN PATENT DOCUMENTS

| | | |
|---|---|---|
| EP | 2390884 A2 | 11/2011 |
| JP | H-0796974 (A) | 12/1990 |
| JP | H-08128742(A) | 5/1996 |
| JP | 09-166365 | 6/1997 |
| JP | 2000205675 (A) | 7/2000 |
| JP | 2004116914 (A) | 4/2004 |
| JP | H-2005090928 (A) | 4/2005 |
| WO | 2009074920 A1 | 6/2009 |

OTHER PUBLICATIONS

Uhlig, K; "Thermal Shunt for Quick Cool-down of two-stage closed-cycle Refrigerator"; Cryogenics, Elsevier, Kidlington, GB, vol. 42, No. 1, Jan. 1, 2002; pp. 67-69.

Prenger, F.C. et al.: "Nitrogen Heat Pipe for Cryocooler Thermal Shunt"; Advances in Cryogenic Engineering; Proceedings of the 1995 Cryogenic Engineering Conference, Plenum Press, New York, NY, US; Columbus, Ohio, USA, vol. 41A, Jan. 1, 1996; pp. 147-154.

Chang, H-M, et al.: "Development of a Thermal Switch for Faster Cool-Down by Two-Stage Cryocooler", Cryogenics, Elsevier, Kidlington, GB, vol. 40, No. 12, Dec. 1, 2000; pp. 769-777.

Ravex, A., et al.: "A Simple and Efficient Thermal Link Assembly for Cryocoolers", Cryogenics, Elsevier, Kidlington, GB, vol. 39, No. 12, Dec. 1, 1999; pp. 997-1001.

* cited by examiner

COOLING APPARATUS AND METHOD

The present application is a National Stage of PCT/GB2011/052201, filed Nov. 11, 2011, which claims the benefit of United Kingdom Patent Application Nos. 1019530.3 filed Nov. 18, 2010 and 1108605.5, filed May 23, 2011. The disclosures of those applications are hereby incorporated in their entirety by reference as if fully set forth herein.

The present invention relates to cooling apparatus and in particular for the rapid cooling of a low temperature target.

BACKGROUND TO THE INVENTION

There are a number of technological applications which require cooling to low temperatures and in particular cryogenic temperatures which may be thought of as those below 100 Kelvin. Liquid helium-4 is often used as a cryogenic coolant due to its boiling point at atmospheric pressure of around 4 Kelvin. Superconducting magnets and other experimental devices are traditionally cooled to around 4 Kelvin using liquid cryogens, these including nitrogen and helium. The relatively large enthalpy content of these cryogens in either liquid or gaseous form ensures a rapid cooling from room temperature down to that of the cryogen in question. Despite the widespread use and success of liquid cryogens, the apparatus necessary to handle such low temperature liquids is often rather bulky, complicated and expensive. Furthermore, the relative scarcity of helium increasingly makes the use of this cryogen unfavourable.

Thus there has been a general trend towards the reduction of the volumes of liquid cryogens used, their cooling power being replaced by mechanical cryo-coolers ("mechanical refrigerators" herein), these include pulse-tube coolers, Gifford McMahon and Stirling coolers. Recent developments in double-staged mechanical refrigerators have enabled a more cost-effective and convenient cooling procedure. However, one particular disadvantage of such mechanical refrigerators is that the relatively small cooling power of the second stage (the lower temperature of the two stages) means that it takes significantly longer to cool an apparatus down using mechanical refrigerators in comparison with liquid cryogens. The greater the thermal mass of the target being cooled, the greater the disadvantage of using mechanical refrigerators because of their low cooling power at low temperatures.

There is a strong desire to improve the cooling power of mechanical refrigerators which would enable practical use of such apparatus in applications for which at present they are not considered available. In some applications, notably high field superconducting magnets, it is expected that the pursuit of ever higher magnetic fields will mean an increase in the thermal mass of the magnets in question and therefore there is a need to improve the cooling performance of mechanical refrigerators if they are to remain useful in cooling superconducting magnets from room temperature to their operating temperature.

SUMMARY OF THE INVENTION

In accordance with a first aspect of the present invention we provide cooling apparatus comprising a mechanical refrigerator having a first cooled stage and a second cooled stage, the second cooled stage being adapted to be coupled thermally with target apparatus to be cooled; and, a heat pipe having a first part coupled thermally to the first stage of the mechanical refrigerator and a second part coupled thermally to a cooled member, the heat pipe being adapted to contain a condensable gaseous coolant when in use; the apparatus being adapted in use to be operated in a first cooling mode in which the temperature of the cooled member causes the coolant within the second part of the heat pipe to be gaseous and the temperature of the first stage causes the coolant in the first part to condense, whereby the cooled member is cooled by the movement of the condensed liquid from the first part to the second part of the heat pipe.

We have realised that the abovementioned problems may be addressed by the novel use of a heat pipe in order to deliver the cooling power of a higher temperature stage of a mechanical refrigerator to a cooled member. The cooled member may be the second stage of the same mechanical refrigerator. It may also take the form of other apparatus such as another part of the cooling apparatus. It may therefore comprise the target apparatus itself or a part thereof, each of which may also be cooled directly by a stage of the mechanical refrigerator. In such cases the cooled member is typically a lower-final-temperature target.

This "short-circuiting" in a thermal sense between the first stage and the cooled member is counter-intuitive although we have realised that this can lead to a significant practical advantage. The cooling power of mechanical refrigerators is usually acceptable in their steady state, that is when the lowest temperature stage is at its nominal base temperature and the target apparatus being cooled is also at approximately that temperature. In this case the cooling power of the mechanical refrigerator needs only to be able to deal with the heat load caused by either the operation of the target apparatus or from the external environment.

The limitations of mechanical refrigerators are therefore temporary and manifest themselves most strongly during the cool-down period when the target apparatus is not yet at its nominal base temperature and the mechanical refrigerator is not yet operating in a steady state. It is in this cooling regime that the invention finds its greatest advantage and application. In particular, we have realised that a heat pipe can be used to provide the cooling power from the first stage (which is much higher than that of the second stage) to the second stage and therefore to the target apparatus, and/or directly to the same or other apparatus acting as the cooled member without the need for any physical movement of couplings, linkages and so on. This ensures that the apparatus cools the cooled member efficiently, effectively, whilst minimising vibration, and whilst avoiding further moving parts and unwanted additional heat loads.

At high temperatures, typically above 100 Kelvin, the first stage of the mechanical refrigerator is noticeably more powerful than the second stage in terms of cooling power. However, since most of the experimental payload is thermally coupled only to the second stage, the cooling power of the first stage is mostly wasted in known systems resulting in the second stage (and the target apparatus) cooling far more slowly than the first stage.

Thus the invention enables the power of the first stage to assist in the cooling of the second stage (or other cooled member). The heat pipe is typically a gas heat pipe that is gravity-driven, as discussed herein, or of any other type. The heat pipe therefore contains, when in use, a gaseous coolant which is capable of being condensed into coolant liquid in the apparatus. The generation of the liquid condensate provides a vehicle for the cooling power of the first stage to be delivered to the second stage of the mechanical refrigerator. This will almost always be a gravity-driven process or could use alternative processes such as the expansion of vaporised coolant to drive the fluid flow.

Whilst the apparatus is adapted to be operated in a first cooling mode within which the invention finds particular advantage, the apparatus is preferably further adapted in use to be operated in a second cooling mode in which the temperature of the first stage in the mechanical refrigerator causes the freezing of the coolant and causes the temperature of the second stage to become lower than the temperature of the first stage. Thus, upon cooling from ambient temperature for example, the apparatus will enter the first cooling mode before entering the second cooling mode. It is therefore preferable to use a coolant which is capable of adopting gaseous, liquid and solid states at temperatures obtainable by the respective stages of the mechanical refrigerator.

It will be appreciated that the choice of the type of coolant and indeed the pressure at which it is supplied to the heat pipe is application specific. One difficulty encountered with the use of mechanical refrigerators is that the actual temperatures attained by the various stages of the mechanical refrigerators when not in a steady state are difficult to control. This causes a problem since the heat pipe will only function effectively if the first part can be cooled to a temperature which causes condensation of the gaseous coolant whereas that of the second part causes evaporation. Upon operating the mechanical refrigerator, the temperature of the first stage may soon fall below the temperature at which the coolant may remain as a liquid and therefore it may solidify which thereafter prevents the heat pipe from operating. In order to prolong such a regime and therefore to maintain the apparatus within the first cooling mode as long as desired, preferably the apparatus further comprises a control system which is adapted to control the environment in the first part of the heat pipe when the apparatus is in the first cooling mode so as to ensure that the gaseous coolant is able to condense but not freeze.

The environment within the heat pipe may therefore be controlled in terms of the pressure and/or temperature of the gas. The temperature is the more readily controllable variable and typically therefore the control system comprises a heater in thermal communication with the first part of the heat pipe. The operation of such a heater ensures that the local temperature in the first part of the heat pipe is maintained within a range which allows the condensation of the coolant gas. It will be appreciated that the control system may include appropriate sensors such as thermocouples in order to ensure the operation of the system in the first mode.

An example coolant is Krypton which has a relatively narrow range of temperatures at which liquid Krypton can exist (this being due to a boiling point of about 120 Kelvin and a melting point of about 116 Kelvin at atmospheric pressure). As an alternative or in addition to the use of the control system (including the heater) it is possible to include a mixture of coolants within the heat pipe, these having overlapping temperature ranges with respect to one another at which the liquid phase may exist. Rather than including more than one coolant type within a heat pipe, as an alternative, multiple heat pipes may be used in parallel, each containing a different coolant type with a corresponding different operational temperature range.

The apparatus may also further comprise an external volume which is placed in fluid communication with the interior of the heat pipe. Such a volume may take the form of a reservoir or storage tank and may be used not only to supply the coolant to the heat pipe initially but also to control the pressure of the coolant within the heat pipe during the various stages of operation of the apparatus. Thus such an external volume may be used by the control system as part of a pressure control function.

It will be appreciated that the interior of the heat pipe typically comprises an internal volume for containing the coolant and which contains the first and second parts in fluid communication with one another. Thus the geometry of the volume may be very simple; indeed it may take the form of a simple cylindrical volume. The first and second parts are typically corresponding first and second ends or end regions of the heat pipe, particularly in the case of a generally cylindrical volume. Regardless of the exact geometry, the first and second parts are typically thermally isolated from each other.

The description above discusses the provision of a mechanical refrigerator having first and second stages. It is however known for some mechanical refrigerators to include three stages and higher numbers are also possible. It will be appreciated that the invention may be used with such mechanical refrigerators having three or more stages and, in principle, the invention may be used to provide cooling between any selected pair of such stages. Indeed, two instances of the present invention could be used to cool between a first stage and an intermediate stage (using a first instance) and between the intermediate stage and the second stage (using a second instance). This might be the case for example when an intermediate stage is used for cooling other apparatus (such as radiation shields). It is also contemplated that a first heat pipe might be used to provide cooling power between a first and third stage, and a second between a second and third stage.

The invention is not limited to the use of any particular kind of target apparatus although great advantage is provided where the thermal mass of the target apparatus is high. The target apparatus includes experimental apparatus or may for example be the still or mixing chamber of a dilution refrigerator for very low temperature experiments. The thermal connection between the heat pipe and the target apparatus may be rigid such as by physical clamping, or via a flexible coupling such as an anti-vibration coupling. An example of such an anti-vibration coupling would be braids of high thermal conductivity copper, these being used to maximise the cooling effect whilst keeping the transmission of vibrations between the target apparatus and the lowest temperature stage to a minimum (particularly where the cooled member is the second stage of the mechanical refrigerator).

It is known that vibrations are a particular problem in apparatus cooled using mechanical refrigerators and therefore a further benefit is provided when the heat pipe comprises walls within which are positioned bellows, these having a vibration-dampening effect.

It will be recalled that the advantage of the invention is gained during the cooling of the apparatus. In the case of particularly sensitive target apparatus the provision of the heat pipe could potentially reduce its operational effectiveness during the steady state operation of the mechanical refrigerator. This might occur due to the heat pipe providing a path for heat to travel between the stages of the mechanical refrigerator. It is therefore preferred that the heat pipe may comprise an anti-radiation member which is operative to reduce the passage of electromagnetic radiation between the first and second parts of the heat pipe. The anti-radiation member is arranged in a manner which nevertheless allows the heat pipe to operate and therefore allows passage of liquid from one side of the member to the opposing side. Thus the coolant may pass around the edge of the member or through one or more small apertures therein.

In accordance with a second aspect of the present invention we provide a method of operating cooling apparatus, the apparatus comprising a mechanical refrigerator having a first cooled stage and a second cooled stage, the second cooled stage being adapted to be coupled thermally with target apparatus to be cooled; and a heat pipe having a first part coupled thermally to the first stage of the mechanical refrigerator and a second part coupled thermally to a cooled member, the heat pipe being adapted to contain a condensable gaseous coolant when in use;

the method comprising:— i) providing a predetermined quantity of coolant to the interior of the heat pipe;

ii) causing the cooled member to adopt a temperature sufficient to ensure the coolant within the second part of the heat pipe is in the gaseous phase;

iii) operating the mechanical refrigerator to cause the first stage of the mechanical refrigerator to adopt a temperature which causes the coolant within the first part of the heat pipe to condense;

iv) cooling the cooled member by causing the movement of the condensed coolant from the first part to the second part of the heat pipe.

It will be appreciated that the method according to the second aspect is preferably used in relation to apparatus according to the first aspect of the invention. Again, it is contemplated that the cooled member may comprise the second stage of the mechanical refrigerator. The method therefore primarily relates to the period during the cool-down of the apparatus which may be thought of the apparatus operating in a first mode. Thereafter, the method according to the second aspect may further comprise operating the mechanical refrigerator after step (iv) to cause the first stage of the mechanical refrigerator to adopt a temperature which causes the coolant within the first part of the heat pipe to freeze and further operating the mechanical refrigerator such that the second stage cools to an operational temperature lower than that of the first stage for using in cooling the target apparatus. This may therefore provide a second mode of operation. In addition, the steady state operation of the apparatus, by which we mean the state in which the first and second stages achieve and maintain an experimentally stable temperature and at which the target apparatus has reached and maintained a target temperature, then follows the operation of step (vi) and can be thought of as a third stage.

The invention therefore provides an apparatus and method for allowing the cooling power of a (or the) higher temperature stage of a mechanical refrigerator to a (or the) lower temperature stage (or otherwise by cooling of cooled members taking other forms) thereby significantly improving the performance of the apparatus by reducing the cool-down time and allowing the use of mechanical refrigerators in applications and for target apparatus for which it was previously not desirable.

BRIEF DESCRIPTION OF THE DRAWINGS

Some examples of an apparatus and method according to the present invention will now be described with reference to the accompanying drawings, in which:—

DESCRIPTION OF PREFERRED EMBODIMENTS

In order to aid the understanding of the invention the discussion below firstly explains the operation of a gravity driven heat pipe as an example and then goes on to illustrate how this may be used in effecting the invention and delivering the advantageous effects which result therefrom.

Figure 1:
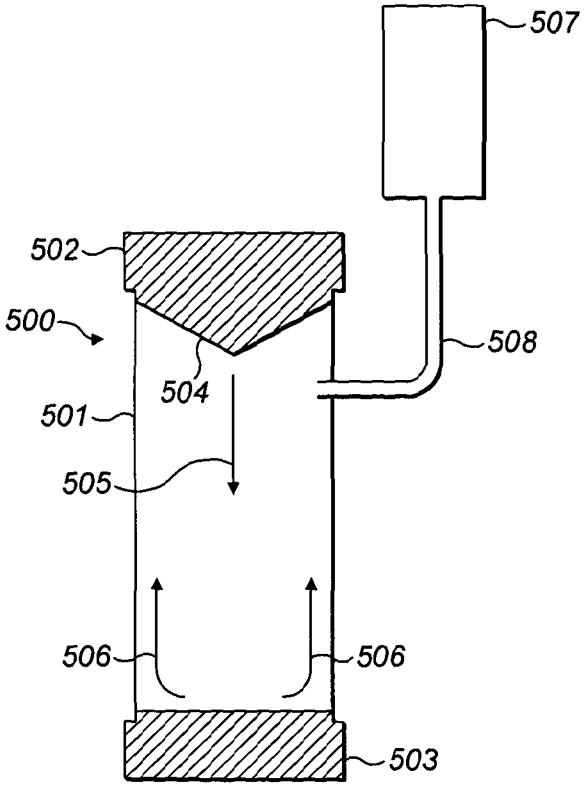
FIG. 1 Prior Art
FIG. 1 is a schematic representation of a heat pipe.

FIG. 1 shows a schematic representation of a heat pipe 500, viewed partly in section from the side. The heat pipe can be thought of as a hollow cylinder having walls 501 extending along the axis of the cylinder. Each end of the heat pipe is sealed by respective end pieces. Since the heat pipe 500 normally adopts an approximately vertical orientation, the end pieces are defined by an upper end piece 502 and a lower end piece 503. In FIG. 1 it will be noted that the upper end piece 502 has an internal surface which is formed in a frusto-conical manner (or as a hyperbolic cone) so as to provide a point 504 positioned approximately centrally within the cylinder (effectively along its axis). Typically the heat pipe walls 501 are formed from thin stainless steel. In addition, the end pieces 502, 503 are also typically formed from a high conductivity material such as high purity copper. Heat pipes such as that shown in FIG. 1 are known in the field of cryogenics and may be filled with a working fluid such as helium-4.

The principle of operation of a heat pipe is as follows. The interior of the heat pipe is sealed with a fixed amount of cryogen. The amount of cryogen used is calculated based upon the operational temperature and pressure at which the heat pipe is designed to operate.

The useful temperature range of a heat pipe is defined by the boiling point and the melting point of the cryogen inside it. A strong thermal link is achieved between the upper end piece 502 and the lower end piece 503 when the temperature of the upper end of the heat pipe is such that the gaseous cryogen within it can condense on the surface. Gravity then draws the liquid condensate down to the lowest point 504 of the upper end piece 502 from which it then drips directly to the lower end piece 503. This is illustrated by the arrow 505. The liquid arriving at the lower end of the heat pipe absorbs heat from the lower end which, if sufficient, causes the cryogen to evaporate and then pass upwards along the length of the heat pipe to the upper end piece 502. The upward flow of gas is illustrated by the arrows 506. Upon contacting the upper end piece 502, the cryogen gas again condenses and travels to the point 504 where it then falls again through the lower end as a liquid. Thus, a cycle is set up which is gravity-driven.

The continuous process of condensation on the upper surface and the evaporation on the lower surface produces a strong thermal link between the two respective ends of the heat pipe. This link is substantially weakened if the upper end of the heat pipe reaches the temperature which is too high for the condensation of the gas at a given operational pressure within the heat pipe. The thermal link therefore becomes significantly weakened since, although gaseous convection may occur, the enthalpy associated with the change of state between gas and liquid is no longer available. Conversely, if the temperature of the upper end of the heat pipe (or indeed of the lower end) is sufficiently low so as to cause solidification of the cryogen the thermal cycle effect ceases and the respective ends become thermally isolated from one another.

FIG. 1 also shows a room temperature expansion volume in the form of a reservoir 507. This may be effected practically by a tank located external to the apparatus within the ambient environment. A tube 508 connects the interior of the reservoir 507 with that of the heat pipe 500. Typically the tube is fitted with a valve (not shown). The reservoir 507 may be used to reduce the pressure within the heat pipe and whether or not such a reservoir is used somewhat depends upon the exact dimensions of the heat pipe and the pressure rating of its components.

Figure 2:
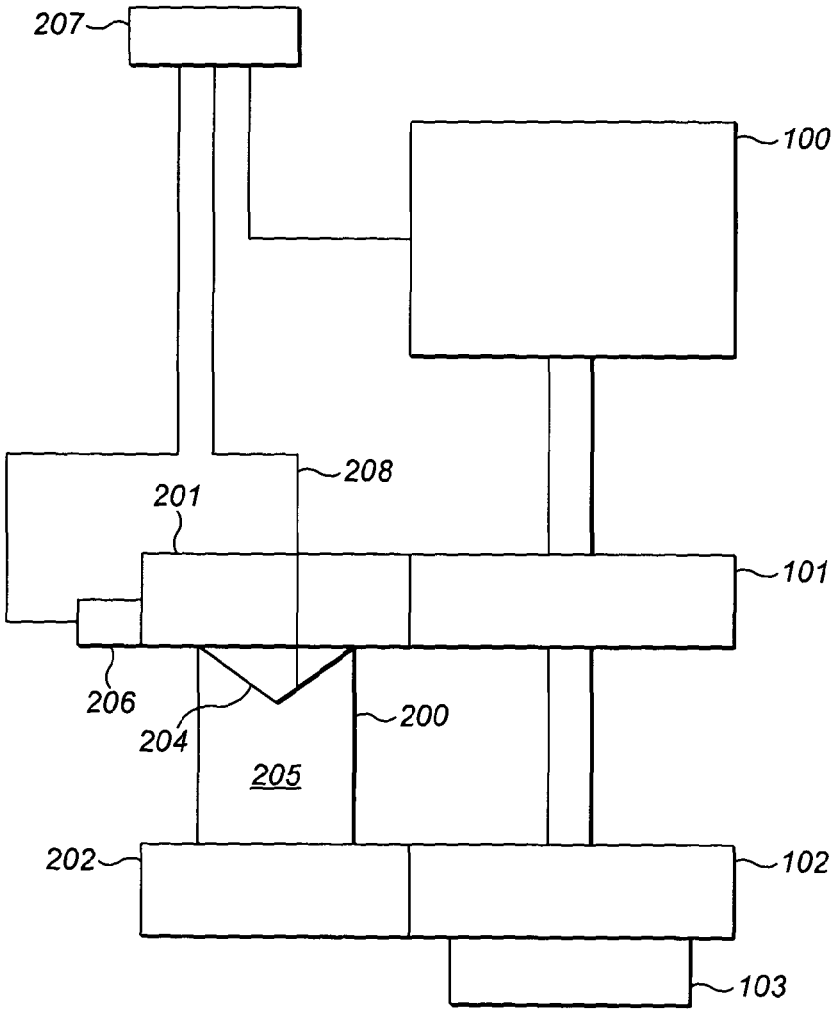
FIG. 2 shows a schematic representation of the positioning of such a heat pipe with respect to a mechanical refrigerator according to a first example of the invention.

FIG. 2 shows a schematic arrangement of apparatus according to an example of the invention. Here a mechanical refrigerator in the form of pulse tube refrigerator is generally illustrated at 100. This may take any known form. In the present case, the pulse tube refrigerator (PTR 100) is a two-stage PTR, having a first stage illustrated at 101 and a second stage at 102. As is known, during steady state operation, the second stage 102 of the PTR 100 attains a low temperature (such as a few Kelvin). This may be used to cool various types of target apparatus, including parts of a magnet system, experimental sensors or other apparatus for experimental use, or for example to pre-cool the still of a dilution refrigerator. Such a target apparatus 103 is illustrated as being attached directly to the second stage 102 of the PTR, this ensuring a good thermal link, thereby maximising the cooling power of the second stage of the PTR 102.

FIG. 2 also illustrates a heat pipe 200, positioned between the first and second stages 101, 102 of the PTR 100. The second stage of the mechanical refrigerator embodies the cooled member in this example. The heat pipe 200 has an upper end 201 and a lower end 202, the upper end 201 being connected via a high thermal conductivity link to the first stage 101. Likewise the lower end 202 is also connected via a high conductivity link to the second stage 102 of the PTR 100. Such a link in each case may be provided via an intermediate member or may be simply by direct, high surface area, connection so as to maximise conductivity of heat across the interface between the respective end and stage. In this example an external volume in the form of a reservoir 507 is not illustrated although it may well be present depending upon the specific application. The 1-5 upper end 201 contains an internal frusto-conical surface 204. The inner volume within the heat pipe 200 is filled with Krypton gas as a coolant 205.

Although the heat pipe 200 is illustrated as being connected to one side of the respective stages 101, 102 of the PTR, it will be understood that this is a schematic representation. In practice, it may be advantageous to provide the heat pipe 200 within the "footprint", that is the geometric envelope, of the PTR 100 since this allows for the retro-fitting of the apparatus to existing equipment as an upgrade to an existing PTR.

Although a PTR 100 is illustrated in FIG. 2, it will be appreciated that similar benefits of the invention may be achieved by the use of other mechanical-refrigerators. A PTR is particularly advantageous since it does not contain moving parts within the low temperature region and therefore it is particularly useful for relatively low vibration operation at low temperatures.

The principle of operation of the heat pipe 200 is that the first and second stages of the PTR 100 are linked thermally during the cooling of the apparatus. At an ambient temperature, the first stage of the PTR has a cooling power of, say, 300 Watts, whereas that of the second cooling stage is around 100 Watts. As the temperature of the stages drops, the cooling power decreases for each, although that of the second stage decreases more severely than that of the first stage, thereby providing an increasing difference in their thermal cooling power as the temperature reduces. It will be appreciated that the target apparatus 103 is connected directly to the second stage 102 of the PTR in FIG. 2 and therefore in the absence of the heat pipe 200 (and more specifically its operation since the respective ends are essentially otherwise isolated from each other thermally), the target apparatus 103 would only be subjected to the cooling power of the second stage 102. The heat pipe 200 allows the cooling power of the first stage to assist in the cooling of the target apparatus 103. Crucially, this occurs only during the cooling of the apparatus, and therefore before the nominal base operational temperatures (steady state) of the stages are reached. Furthermore, the advantageous transfer of the cooling power from the first stage to the second stage by the heat pipe is only provided during the cooling down of the apparatus and it is important that this effect ceases before the apparatus reaches the base temperature for steady state operation. The first stage therefore assists in cooling of the second stage until the latter has reached such a temperature and the power of the first stage is no longer required. When the cooling power of the first stage is being provided to the second stage, this is caused by the establishment of a gravity-cycle within the heat pipe 200. This cycle is the same cycle as is described with respect to FIG. 1, namely the condensation from the gaseous phase of Krypton at the upper end 201 of the heat pipe, the dripping of the liquid to the lower end 202 and the heating of this liquid to cause evaporation at the lower end 202. The Krypton gas which has evaporated then travels up the heat pipe 200 to again condense on the surface of the upper end 201.

By virtue of the design, the condensation inside the heat pipe will cease at a predetermined temperature in order to isolate the second stage 102 from the first stage 101. The thermal isolation then allows the second stage 102 to cool further until it reaches its nominal base temperature for steady state operation.

Figure 3:
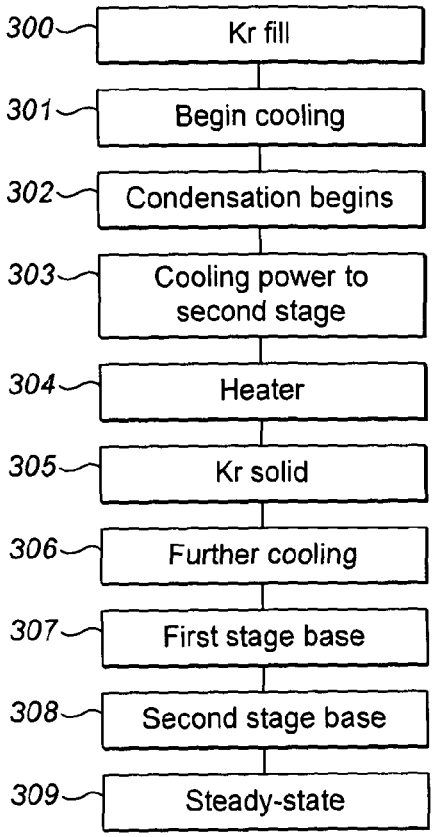
FIG. 3 is a flow diagram of the use of the apparatus of the first example.

We refer now to FIG. 3 which is a flow diagram of a method of operating the apparatus shown in FIG. 2. In addition, a reference is made to FIG. 4 in which the temperatures of the first stage 101 (shown as "PT1") and the second stage 102 (shown as "PT2") are plotted on a temperature-time graph. As noted above, the cryogen in the present example is Krypton gas although other gases or mixtures of gases are possible and should be considered by those wishing to practically implement the invention. The method described in FIG. 3 relates to the cooling down of the apparatus from ambient temperature to the operational nominal base temperature by which the steady state operation is effected.

Figure 4:
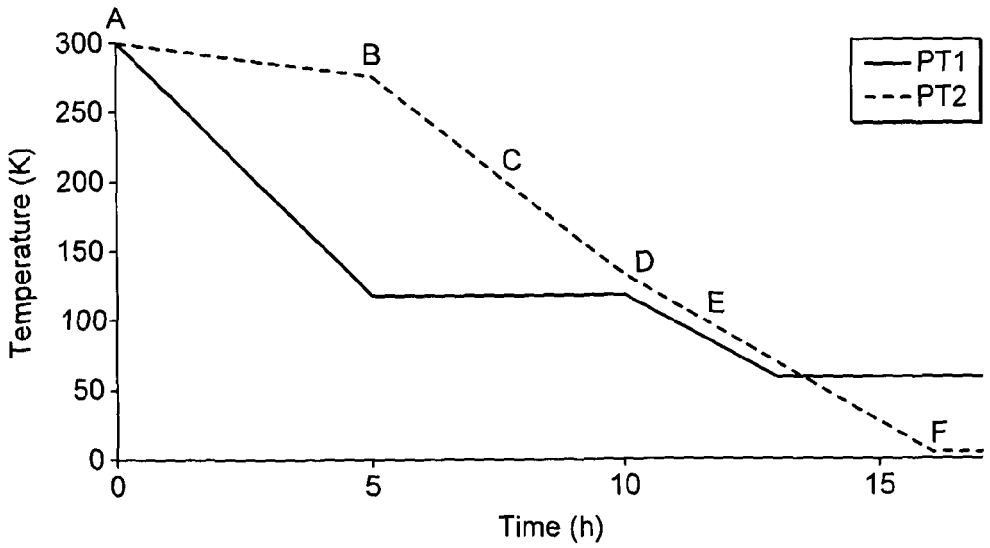
FIG. 4 is a temperature-time graph illustrating the operational regime of the examples of the invention.

Initially, the heat pipe 200 is charged with Krypton gas at step 300. In the present case a pressure of approximately three atmospheres is used. It should be noted that Krypton gas has an atmospheric (one atmosphere pressure) boiling point of 120 Kelvin and a melting point of 116 Kelvin. With reference to FIG. 4, step 300 is represented on the temperature-time graph at point A. The cooling of the PTR begins at step 301. As will be appreciated by those of ordinary skill in the art, when operating a PTR such as PTR 100 positioned within a cryostat, the first stage 101 cools significantly more quickly than the second stage 102, particularly if there is a significant thermal mass attached only to the second stage. This is illustrated in FIG. 4 by the relative negative gradients of the curves illustrating the temperature of the first and second stages. For example after a period of around 5 hours, the second stage has only cooled by 10 to 20 degrees Kelvin with respect to ambient temperature. In comparison, the first stage has cooled to a temperature of 120 Kelvin which it will be recalled is the boiling point of the Krypton gas. It will be recalled that the first stage 101 of the PTR 100 is in strong thermal communication with the upper end 201 of the heat pipe 200. Essentially therefore, the upper end is at the same temperature as the first stage. At this temperature, the Krypton gas within the heat pipe 200 begins to condense upon the surface 204. This is illustrated at point B in FIG. 4. Thus the condensation process starts and this provides a significantly increased cooling power to the second stage by virtue of the cold liquid dripping from the upper end 201 to the lower end 202 of the heat pipe 200. As can be seen from FIG. 4, at this time the temperature of the second stage is in excess of 120 Kelvin and therefore the liquid arriving at the lower end of the heat pipe is heated and evaporates, this travelling back to the upper end for further condensation. This process continues at step 303. As is shown in FIG. 4, the second stage therefore undergoes accelerated cooling (a more negative gradient of the temperature-time curve) whereas the temperature of the first stage remains constant. As the second stage cools further, such as at point C, the heat load on the first stage will decrease. This may be disadvantageous since the first stage may begin cooling the Krypton to a temperature below its melting point. In order to prevent this, a heater is mounted to the upper end 201 of the heat pipe. This is illustrated schematically at 206 in FIG. 2. Although the heater is not essential and therefore may be absent in certain practical applications, it is useful in the present case to enhance the cooling of the second stage. This may seem somewhat counterintuitive although it may be understood by reference to FIG. 4. In particular, it is designed that the second stage temperature reaches the point D before the freezing of the Krypton occurs. In order to exact control over this process, a controller 207 is provided as is shown in FIG. 2, this being connected to the PTR 100 and the heater 206. In addition, a temperature sensor such as a thermocouple 208 is provided for measuring the temperature of the Krypton in the upper part of the chamber of the heat pipe adjacent the upper end 201. This is illustrated at 208 in FIG. 2.

Returning now to FIGS. 3 and 4 and the description of the method, the operation of the heater is shown at 304 in FIG. 3. The heater is used to apply an appropriate amount of heat to the first stage until the second stage has cooled to around 120 Kelvin (point D). At this point the heater is switched off and the first stage is then allowed to cool further. Once the first stage reaches 116 Kelvin at point E, the liquid Krypton will solidify at the upper end of the heat pipe. The heat transport inside the heat pipe then finishes at step 305. Thereafter, each of the first and second stages cool further at step 306. The first stage reaches its operational nominal base temperature at step 307, notably earlier than the attainment of the base temperature by the second stage. An example nominal base temperature is 50 Kelvin for the first stage. As is shown in FIG. 4, the second stage eventually reaches its nominal base temperature at point F such as 4.2 Kelvin or lower (step 308). Finally, the target apparatus reaches its operational temperature once the second stage is cooled to its base temperature and then the apparatus is ready for steady state operation which is illustrated at step 309.

As will be appreciated, the heat pipe will only accelerate the cooling between points B and D of the graph shown in FIG. 4. In particular it will not provide this function at temperatures either above or below these points (save for the natural convection of gas in the pipe at elevated temperatures). For this reason it may be advantageous to use a mixture of gases with different melting and boiling points inside the heat pipe 200 (or equivalent multiple heat pipes, each with its own coolant) which would aid the cooling at higher and/or lower temperatures and therefore provide a greater operational temperature range.

In the ideal case, all the cooling power of the first stage at point B will be added to the cooling power of the second stage. In the case of the use of a coolant such as Krypton, on a typical filter tube refrigerator, this would equate to an additional 150 Watts of cooling power. In comparison, the average cooling power between points B and D without a heat pipe would be less than 75 Watts. Thus, the invention provides the ability to more than double the cooling power within the operational range of the heat pipe in practical applications.

Figure 5:
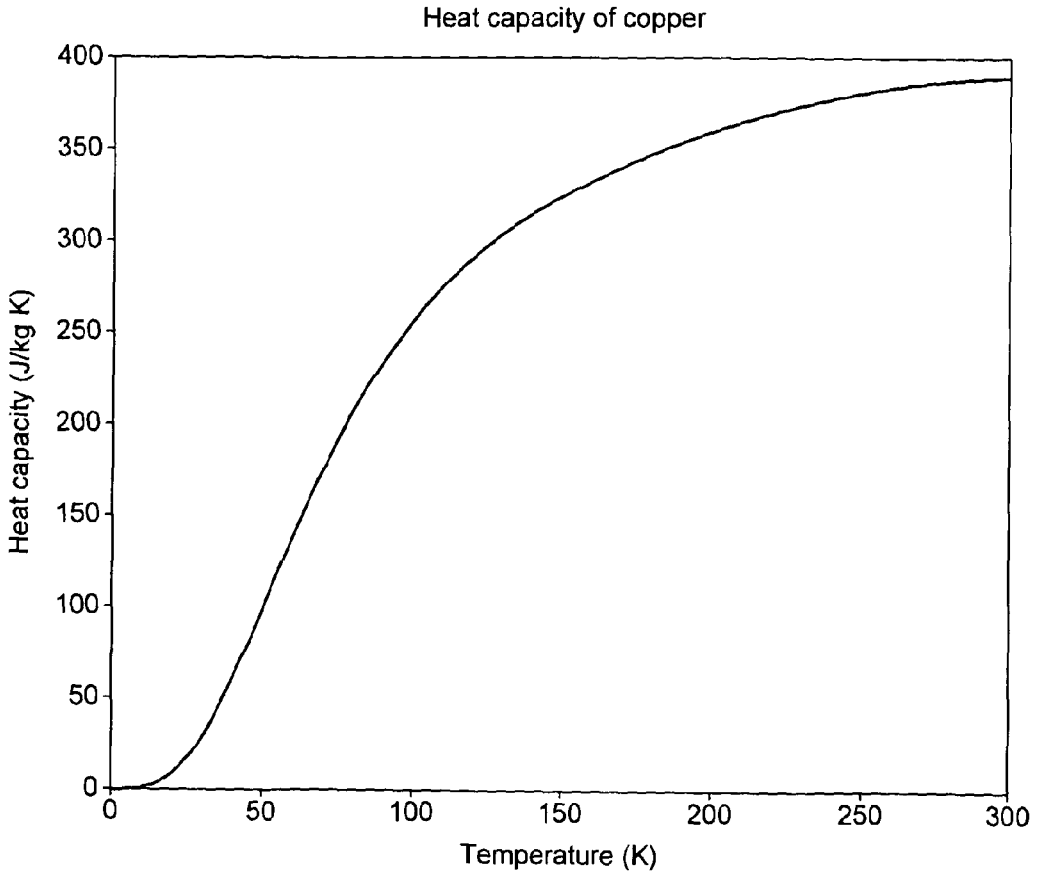
FIG. 5 illustrates the variation in the heat capacity of copper as a function of temperature.

The benefit of the heat pipe will be further appreciated by reference to FIG. 5. FIG. 5 illustrates the heat capacity of copper as a function of temperature. As can be seen, the room temperature heat capacity of copper is around 390 J/kg/K, whereas this drops below 100 at the base temperature of the first stage of the PTR. At the base temperature of the second stage, the heat capacity may be less than 10 J/kg/K. The heat capacity drops quickly at temperatures below 100 Kelvin and it is the cooling power at higher temperatures that largely determines the overall cool-down time. The heat pipe therefore adds cooling power just at the temperatures where it is needed the most. Thus the invention provides the ability to significantly boost the cooling in the operational regime of temperature where it provides its greatest benefit.

Figure 6:
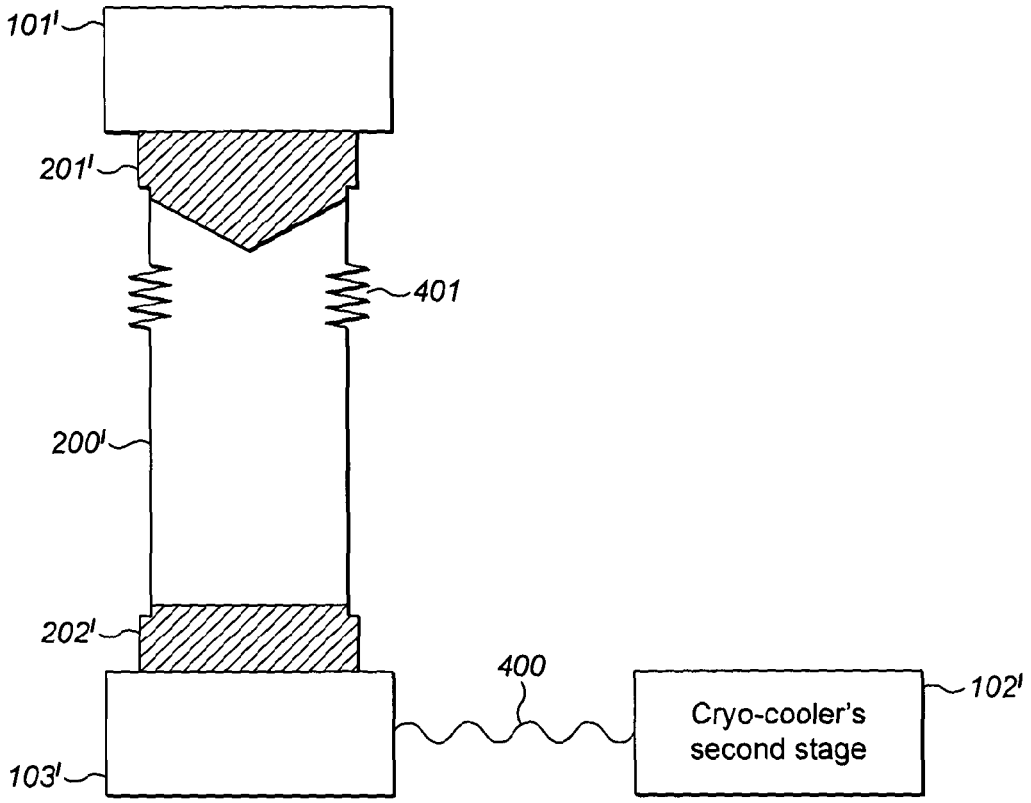
FIG. 6 shows a second example with anti-vibration features.

FIG. 6 illustrates a second example arrangement in which components which are analogous to those shown in FIG. 2 are given primed reference numerals. In this second example, the first stage of the PTR 101' has a lower surface to which the upper end 201' of the heat pipe 200' is connected directly. Furthermore, the target apparatus 103' is connected directly by a suitable mounting to the lower end 202' of the heat pipe 200'. This example includes anti-vibration features. The first of these is shown at 400 where an anti-vibration coupling separates the target apparatus 103 (in this case an experimental payload) from the second stage 102'. This coupling 400 may take the form of copper braid. Such a mechanism is useful when the experimental payload of the target apparatus 103' is sensitive apparatus such as a superconducting magnet. The high conductivity braid, which is typically formed of copper, prevents the transmission of vibrations to the experimental payload. A further aspect of this anti-vibration example is the presence of edge-welded bellows 401 within the wall of the heat pipe 200'. This allows the heat pipe to connect directly to the PTR's first stage without the target apparatus 103' being subject to unacceptable vibrations. As will be appreciated, without the presence of the edge-welded bellow 401, vibrations would be able to propagate relatively easily along the heat pipe thus bypassing the anti-vibration coupling 400 between the second stage in the experimental payload of the target apparatus 103'. The thermal benefit of the use of the heat pipe during cooling is even greater in this second example since the anti-vibration couplings generally reduce the available cooling power of the second stage by as much of a factor as two due to a temperature gradient forming across the coupling when in use. Therefore the provision of an additional 150 Watts (in the case of a PTR) from the first stage will be even more noticeable.

Figure 7:
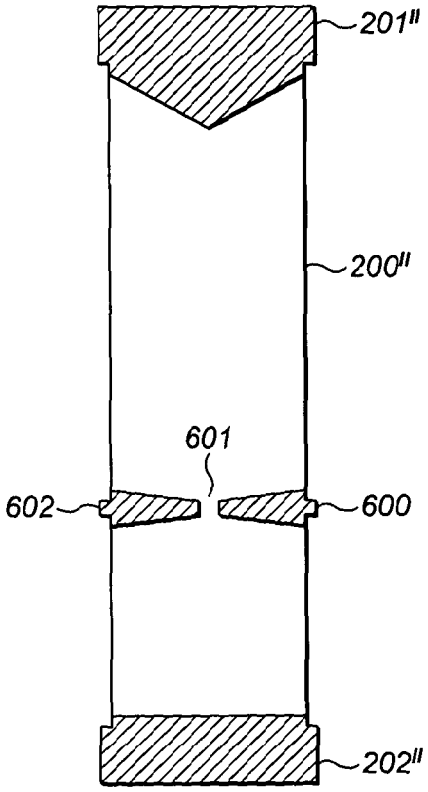
FIG. 7 illustrates the provision of an anti-radiation member within the heat pipe as a third example.

A third example apparatus is illustrated in FIG. 7. In this case components which are analogous to those of FIG. 2 are illustrated with double-primed reference numerals. The heat pipe 200" again has an upper end 201" and a lower end 202". In addition however an anti-radiation member 600 is positioned intermediately between the upper and lower ends. The anti-radiation member 600 takes the general form of a disc which, in the case of a right circular cylindrical heat pipe 200", is circular in form and of approximately of similar radius. The disc is provided with a small central orifice and the thickness of the disc reduces generally linearly towards its central orifice position. The anti-radiation member 600 is arranged within the heat pipe 200" such that the axis of the heat pipe passes through the orifice and is approximately parallel to the plane defining the disc. The tapering of the thickness ensures that an upper surface of the anti-radiation member 600 which receives liquid condensate from the upper end 201" above, causes the liquid to flow towards and pass through the orifice. The orifice is illustrated at 601 in FIG. 7.

At least part (a peripheral portion) of the anti-radiation member 600 is arranged to pass through the walls of the heat pipe 200" so as to allow thermal connection to the second stage of the PTR at a point illustrated at 602. The purpose of the anti-radiation member with associated small orifice is to reduce the thermal radiation from the upper end of the heat pipe. This is particularly useful in applications where the experimental payload of the target apparatus consists of a secondary refrigerator system such as a dilution refrigerator or a helium-3 refrigerator which is very sensitive to thermal radiation. The orifice typically is a few millimeters in diameter which is small enough to prevent most of the radiation from passing between the ends, but not so small as to restrict the flow of liquid or gas. The thermal linking of the second stage to the anti-radiation member allows for the target apparatus to be at a lower temperature than that of the second stage. This will cause the cooling of the second stage and also of the target apparatus 103" during the cooling cycle.

Figure 8:
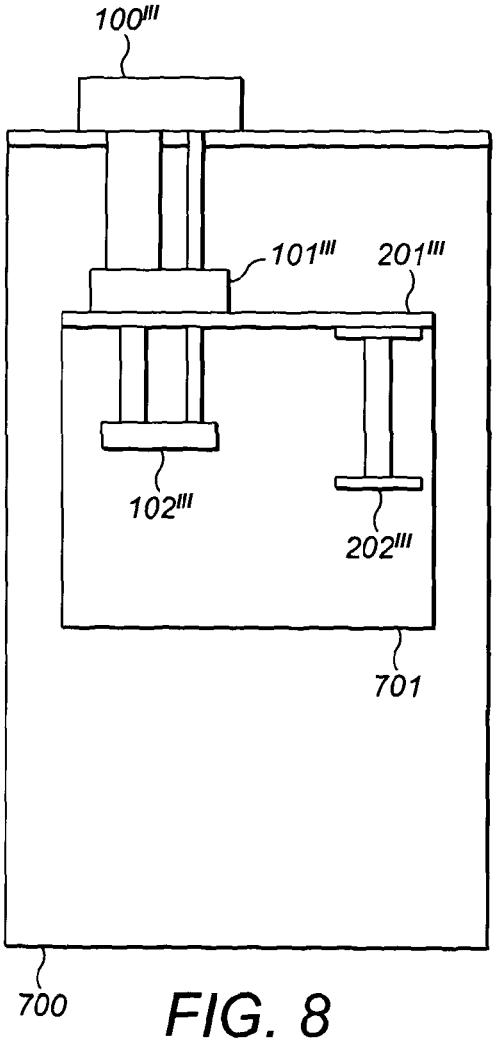
FIG. 8 shows a fourth example in which the second part of the heat pipe is used to cool other apparatus directly.

A fourth example is shown schematically in FIG. 8 with triple-primed reference numerals denoting analogous components to those shown in the previous examples. In this case the arrangement with reference to the first stage 101'" of the PTR 100'" is similar to the other examples. However, the second stage 102'" of the PTR 100'" is not in thermal contact with the second part 202'" of the heat pipe. Although not shown in FIG. 8, the lower part of the heat pipe may be placed in thermal contact with a range of apparatus. Typically this is advantageous in applications where the ultimate operational temperature of the apparatus is below the steady-state operational temperature of the second stage (or the lowest temperature stage) of the mechanical refrigerator. As illustrated, the upper end of the heat pipe 201'" is equipped with a heater and temperature sensors, this being in thermal contact with the first stage of the PTR. One ore more additional heaters and temperature sensors are placed at the lower end 202'" of the heat pipe. The first and second stages of the PTR and the heat pipe are enclosed within a "vacuum can" 700 of a cryostat, with the first stage of the PTR arranged to cool radiation shields 701 which surround the second stage, heat pipe and the apparatus to be cooled (cooled member).

Figure 9:
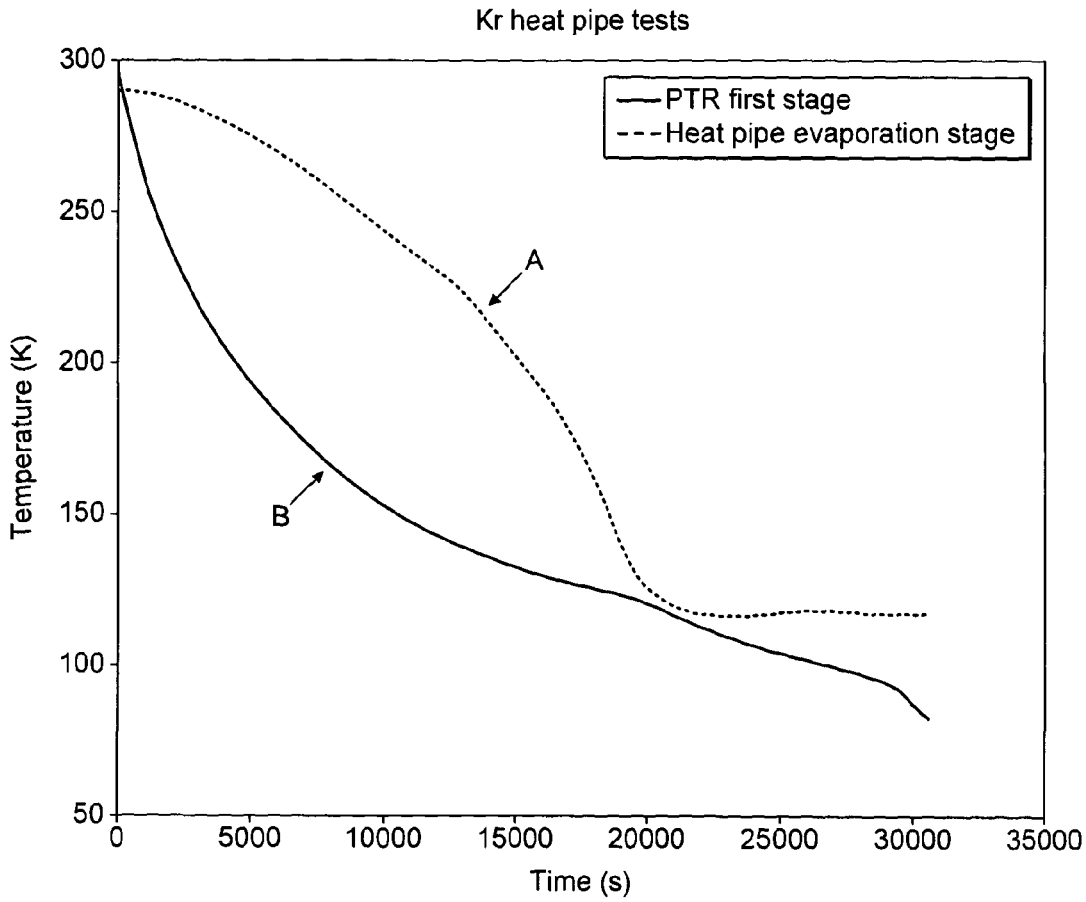
FIG. 9 illustrates experimental data for a heat pipe containing krypton according to the fourth example; and, FIG. 10 shows a graph comparing the cooling performance of a known system in comparison with that of an example according to the invention.

FIG. 9 demonstrates experimental results for cooling such apparatus. In the graph shown in FIG. 9, the upper curve A shows the temperature of the lower part of the heat pipe 202'" during cooling of the system as a function of time. The lower curve B shows the temperature of the first stage 201'" of the PTR 200'".

It can be seen that at times before about 20000 seconds, the temperature of the first stage of the PTR is lower than that of the lower part of the heat pipe. This is because the first stage of the PTR cools rapidly during this phase whereas, in comparison, the lower part of the heat pipe cools only slowly due to natural convection and residual thermal conduction. It is notable that the cooling rate of the lower part of the heat pipe steadily increases throughout almost all of this period. This illustrates the significant cooling power being transferred from the PTR to the bottom of the heat pipe as the heat pipe starts to operate effectively. Thus, the rate of cooling of the first stage 201'" slows as cooling power is transferred to the heat pipe. When the heat pipe is cooling at its fastest, just before 20000 s, the temperature of the first stage approaches a constant, which demonstrates that effectively all of the excess cooling power is being transferred to the heat pipe.

After a period of about 20000 seconds the temperature of the lower part of the heat pipe suddenly stabilises as the krypton within it freezes and the apparatus enters a second stage of cooling. The first stage is then able to continue cooling and the gradient of the lower curve (PTR first stage) then becomes steeper as the cooling power is transferred from the heat pipe to the first stage. The temperature of the first stage then drops further with respect to the lower part of the heat pipe. It is notable that, for this experimental arrangement, the cool-down process was entirely "passive" in the sense that no active temperature control was required as the efficiency of the heat transfer to the heat pipe made the system self-regulating.

In each of the above examples, a second gas such as neon may be used in addition to Krypton within the same heat pipe (or in a second pipe or pipes). The neon would be effective for providing the heat pipe effect at temperatures around 25 Kelvin. In this case therefore effectively a second effect is set up within the same heat pipe when at the lower temperature such that the anti-radiation member becomes effectively the upper end of the neon heat pipe and the target apparatus becomes the lower end of the heat pipe. The target apparatus therefore undergoes accelerated cooling until such a time as the neon is frozen by the second stage of the PTR. As for the first stage, a heater may be provided to assist in this process.

Figure 10:
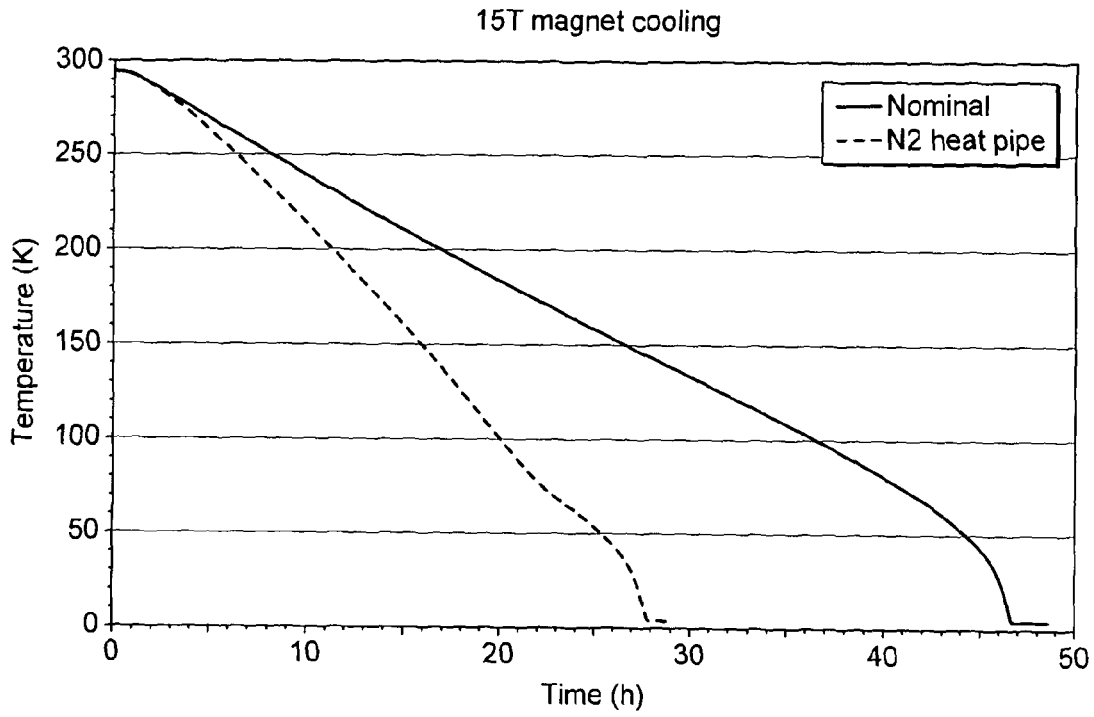

FIG. 10 illustrates the difference in cooling performance provided by a system according to the invention in comparison with a conventional system. In this case a 15 Tesla cryogen-free magnet system was cooled by a mechanical refrigerator system fitted with a heat pipe as described. The magnet had a mass of about 50 kg. FIG. 10 is a graph of temperature (in Kelvin) versus time (in hours) of target apparatus in thermal communication with the second stage of the PTR. The "Nominal" or conventional system (without the heat pipe fitted) has a cool-down time of over 46 hours from room temperature. This is illustrated by the upper of the two curves. In contrast, the lower curve, representing an equivalent system using a heat pipe containing nitrogen ($N_2$) reaches the same steady state base temperature (below 4 Kelvin) in 28 hours. FIG. 10 therefore illustrates the substantial performance increase which can be achieved using the invention described herein.

The invention claimed is:

1. Cooling apparatus comprising:— a mechanical refrigerator having a first cooled stage and a second cooled stage, the second cooled stage being adapted to be coupled thermally with target apparatus to be cooled; and, a heat pipe having a first part coupled thermally to the first stage of the mechanical refrigerator and a second part coupled thermally to a cooled member, the heat pipe being adapted to contain a condensable gaseous coolant when in use;

the apparatus being adapted in use to be operated in a first cooling mode in which the temperature of the cooled member causes the coolant within the second part of the heat pipe to be gaseous and the temperature of the first stage causes the coolant in the first part to condense, whereby the cooled member is cooled by the movement of the condensed liquid from the first part to the second part of the heat pipe;

wherein the heat pipe further comprises walls within which are positioned flexible bellows configured to dampen vibrations between the first cooled stage and the target apparatus.

2. The apparatus according to claim 1, wherein the apparatus is further adapted in use to be operated in an second cooling mode in which the temperature of the first stage of the mechanical refrigerator causes the freezing of the coolant and causes the temperature of the second stage to become lower than the temperature of the first stage.

3. The apparatus according to claim 1, further comprising a control system adapted to control the environment in the first part of the heat pipe when the apparatus is in the first cooling mode so as to ensure that the gaseous coolant is able to condense.

4. The apparatus according to claim 3, wherein the control system comprises a heater in thermal communication with the first part of the heat pipe.

5. The apparatus according to claim 1, further comprising a coolant gas or mixture of gases sealed within the heat pipe.

6. The apparatus according to claim 5, wherein the coolant comprises Krypton.

7. The apparatus according to claim 1, further comprising an external volume in fluid communication with the interior of the heat pipe.

8. The apparatus according to claim 1, wherein the heat pipe comprises an internal volume for containing the coolant, and which contains the first and second parts in fluid communication with one another.

9. The apparatus according to claim 1 wherein the mechanical refrigerator may comprise an additional cooled stage, the said additional stage being either an intermediate stage between the first and second stages, or being a third stage.

10. The apparatus according to claim 1, further comprising target apparatus, thermally coupled to the stage of the refrigerator which is capable of attaining the lowest operational temperature, the thermal coupling being through a high thermal conductivity member.

11. The apparatus according to claim 1, wherein the heat pipe may further comprise an anti-radiation member operative to reduce the passage of electromagnetic radiation between the first and second parts, the anti-radiation member being arranged to allow passage of liquid from one side of the member to the opposing side.

12. The apparatus according to claim 1, wherein the cooled member is the second stage of the mechanical refrigerator.

13. A method of operating cooling apparatus, the apparatus comprising a mechanical refrigerator having a first cooled stage and a second cooled stage, the second cooled stage being adapted to be coupled thermally with target apparatus to be cooled; and a heat pipe having a first part coupled thermally to the first stage of the mechanical refrigerator and a second part coupled thermally to a cooled member, the heat pipe being adapted to contain a condensable gaseous coolant when in use, and wherein the heat pipe further comprises walls within which are positioned flexible bellows configured to dampen vibrations between the first cooled stage and the target apparatus;

the method comprising:

i) providing a predetermined quantity of coolant to the interior of the heat pipe;

ii) causing the cooled member to adopt a temperature sufficient to ensure the coolant within the second part of the heat pipe is in the gaseous phase;

iii) operating the mechanical refrigerator to cause the first stage of the mechanical refrigerator to adopt a temperature which causes the coolant within the first part of the heat pipe to condense; and iv) cooling the cooled member by causing the movement of the condensed coolant from the first part to the second part of the heat pipe.

14. The method according to claim 13, further comprising:— v) operating the mechanical refrigerator after step (iv) to cause the first stage of the mechanical refrigerator to adopt a temperature which causes the coolant within the first part of the heat pipe to freeze; and, vi) further operating the mechanical refrigerator such that the second stage cools to an operational temperature lower than that of the first stage for using in cooling the target apparatus.

* * * * *